US012680548B2

(12) United States Patent
Kellermann et al.

(10) Patent No.: US 12,680,548 B2
(45) Date of Patent: Jul. 14, 2026

(54) LIQUID PUMP PERMANENT MAGNET ROTOR WITH PLASTIC INSERT AND CHANNEL ARRANGEMENT

(71) Applicant: BÜHLER MOTOR GMBH, Nuremberg (DE)

(72) Inventors: Helmut Kellermann, Langenzenn (DE); Christian Zimmerer, Pottenstein (DE); Thomas Stolpe, Eckental (DE); Dominik Neudert, Altdorf (DE)

(73) Assignee: BÜHLER MOTOR GMBH, Nuremberg (DE)

( * ) Notice: Subject to any disclaimer, the term of this patent is extended or adjusted under 35 U.S.C. 154(b) by 0 days.

(21) Appl. No.: 19/215,869

(22) Filed: May 22, 2025

(65) Prior Publication Data

US 2025/0286422 A1 Sep. 11, 2025

Related U.S. Application Data

(63) Continuation of application No. PCT/EP2023/081462, filed on Nov. 10, 2023.

(30) Foreign Application Priority Data

Nov. 25, 2022 (DE) ..... 10 2022 131 228.3

(51) Int. Cl.
*F04D 13/06* (2006.01)
*F04D 29/02* (2006.01)
*F04D 29/58* (2006.01)

(52) U.S. Cl.
CPC ..... *F04D 13/064* (2013.01); *F04D 29/026* (2013.01); *F04D 29/588* (2013.01); *F04D 29/5806* (2013.01); *F04D 29/5813* (2013.01)

(58) Field of Classification Search
CPC ..... F04D 13/06; F04D 13/064; F04D 29/026; F04D 29/588; F04D 29/5806;
(Continued)

(56) References Cited

U.S. PATENT DOCUMENTS

2004/0234395 A1* 11/2004 Hatano ..... F04D 13/0673 417/423.1
2015/0211523 A1* 7/2015 Bernreuther ..... F04D 29/2227 416/3

FOREIGN PATENT DOCUMENTS

CN 109322851 A 2/2019
CN 111237247 A 6/2020
(Continued)

OTHER PUBLICATIONS

English Machine Translation of CN-111237247-B (Year: 2021).*
(Continued)

*Primary Examiner* — Nathan C Zollinger
(74) *Attorney, Agent, or Firm* — WHDA, LLP

(57) ABSTRACT

A liquid pump with a housing in which a wound stator and electronics are arranged in a dry area. A permanent magnet rotor is arranged in a wet area. A shaft is held on the one hand in a pump head and on the other hand in a shaft receptacle in a containment shell. The containment shell separates the dry area from the wet area. At least one bearing is incorporated in the permanent magnet rotor and is arranged rotatably on the shaft, wherein the permanent magnet rotor comprises a plastic insert and a permanent magnet, and at least one fluid channel runs parallel to the axis and is formed between the plastic insert and the permanent magnet.

11 Claims, 5 Drawing Sheets

(58) Field of Classification Search
CPC ..... F04D 29/5813; H02K 9/19; H02K 1/32; H02K 21/14
See application file for complete search history.

(56) References Cited

FOREIGN PATENT DOCUMENTS

| | | | | | |
|---|---|---|---|---|---|
| CN | 111237247 | B | * | 11/2021 | ..... F04D 29/20 |
| DE | 100 51 239 | A1 | | 4/2002 | |
| DE | 10 2021 131 017 | A1 | | 5/2023 | |
| JP | 2000205173 | A | * | 7/2000 | |

OTHER PUBLICATIONS

International Search Report dated Feb. 6, 2024, issued in counterpart International Application No. PCT/EP2023/081462 (2 pages).
Office Action dated Jul. 12, 2023, issued in counterpart of DE Patent Application No. 10 2022 131 228.3 (12 pages).
Office Action dated Nov. 27, 2024, issued in counterpart of DE Patent Application No. 10 2022 131 228.3 (8 pages).

* cited by examiner

LIQUID PUMP PERMANENT MAGNET ROTOR WITH PLASTIC INSERT AND CHANNEL ARRANGEMENT

CROSS-REFERENCE TO RELATED APPLICATIONS

The present patent application claims priority from German Application No. DE 10 2022 131 228.3, filed Nov. 25, 2022, which was filed as PCT application No. PCT/EP2023/081462 (International Publication No. WO/2024/110222, published on May 30, 2024). Both applications are incorporated herein by reference in their entirety.

BACKGROUND OF THE INVENTION

Field of the Invention

The invention relates to a liquid pump with a housing in which a wound stator and electronics are arranged in a dry area, and a permanent magnet rotor arranged in a wet area as well as a method for producing the liquid pump.

Description of Related Art Including Information Disclosed Under 37 CFR 1.97 and 1.98

Known liquid pumps have a multi-part housing in which a dry area and a wet area are formed. A rotor around which fluid flows is arranged in the wet area. A containment shell separates the wet area from the dry area and contains the rotor around which fluid flows. The stator is located in the dry area. Furthermore, most known liquid pumps have an additional electronics compartment in which the control electronics are housed. The fluid is fed into the wet area via an impeller and flows around the rotor. It is known to form additional axial fluid channels in the form of recesses in the region of a radial bearing. The disadvantage is a reduced force distribution due to the resulting smaller bearing surface. In addition, dirt particles and foreign bodies from the fluid flow can be unintentionally transported directly into the bearing and settle there, which can lead to damage to the pump. It is also known to form fluid channels that arise during assembly. The disadvantage of this is that additional assembly work arises, and the area for force-fit connections is reduced.

The object of the invention is to provide a liquid pump that overcomes the above-mentioned disadvantages and ensures optimal cooling and heat dissipation. In addition, higher temperature resistance should be ensured without affecting the dirt load capacity or the bearing quality.

BRIEF SUMMARY OF THE INVENTION

A liquid pump comprises a housing in which a wound stator and electronics are arranged in a dry area. A permanent magnet rotor is arranged in a wet area. A shaft is held on the one hand in a pump head and on the other hand in an shaft receptacle in a containment shell. The containment shell separates the dry area from the wet area. In addition, the liquid pump has at least one bearing which is incorporated in the permanent magnet rotor, for example by pressing in, injection or by a force as well as by form fit. The bearing arranges the permanent magnet rotor so that it can rotate on the shaft or supports it on the shaft. The permanent magnet rotor comprises a plastic insert and a permanent magnet. At least one fluid channel running parallel to the axis is formed between the plastic insert and the permanent magnet. This creates a fluid channel that forms a connection from the fluid region of an impeller to an inner wall of the containment shell, which is arranged on a circuit board. This increases fluid exchange and improves cooling performance in the circuit board.

The advantage is that the fluid channel is not formed in the region of the radial bearing. Consequently, the area available for force-fit connections is increased, the quality of the concentricity of the rotor is improved, a higher possible radial load is enabled by a larger running surface, and a higher dirt load capacity is ensured since the fluid exchange does not take place via the bearing.

The plastic insert has a receiving contour in the inner region to accommodate the shaft and at least one bearing. The inner region is formed to fit snugly and tightly to the shaft and the at least one bearing during the injection molding process.

In a further development, the plastic insert is formed in one piece with an impeller made of the same material. In this case, the plastic insert and the impeller are preferably made of a non-magnetic material such as PPS (polyphenylene sulfide) or another thermoplastic material known to a person skilled in the art.

In another advantageous design, the plastic insert has at least one axially parallel rib on its outer peripheral surface or is designed without ribs. The at least one rib can be variably adapted to the length of the plastic insert. The at least one rib ensures optimal plastic flow during the production of the plastic insert. The plastic flows to the designated locations in the injection mold and forms the plastic insert before the plastic hardens.

It is advantageous that at least one projection is formed on an underside of the impeller and is arranged radially around a section of the plastic insert. The projection is formed in a ring-like manner around the upper region of the plastic insert.

In a further development, at least one injection point is formed on the outer surface and/or the inner surface of the at least one projection. The at least one injection point ensures volume in the injection mold and is important for the plastic injection. One or more injection points are arranged radially symmetrically on the outer surface and/or the inner surface of at least one projection and ensure uniform filling of the plastic insert. Another advantage of having at least one injection point is the relatively quick and even application of the plastic during injection molding.

In another advantageous design, at least one material flattening is formed on the outer surface and/or inner surface of the at least one projection. The material flattening serves as an orientation aid for the plastic insert in the mold before the plastic insert is overmolded with permanent magnetic material.

It is advantageous that the at least one projection has at least one recess in the direction of the underside of the impeller. The at least one recess serves as an axial safeguard for the permanent magnetic material against axial slipping off the plastic insert. Due to the adhesive effect of the permanent magnetic material on at least one recess, no unwanted axial disassembly occurs.

In a preferred design, the permanent magnetic material encloses the at least one projection and the at least one injection point and forms the permanent magnet rotor. By enclosing the at least one projection and the at least one injection point, the permanent magnetic material is radially secured against slipping off the plastic insert.

In an alternative embodiment, the plastic insert and a permanent magnet are designed as finished parts that are mounted in one another in a force-fit, integral bond or form-fit and thereby form the permanent magnet rotor. The assembly of the prefabricated parts can be joined together by pressing, gluing or other assembly methods known to a person skilled in the art.

In another advantageous design, while applying the permanent magnetic material to the plastic insert, at least one fluid channel running parallel to the axis is formed between the plastic insert and the permanent magnet. However, other fluid channels running parallel to the axis are also possible. Unrequired fluid channels can be filled with permanent magnetic material. The at least one fluid channel running parallel to the axis merges into a circumferential fluid channel in the lower region of the plastic insert. If there are several fluid channels running parallel to the axis, these are arranged radially symmetrically, i.e. two fluid channels are arranged opposite each other, three fluid channels are arranged offset by 120 degrees to each other, etc.

It is advantageous that at least one fluid bore is formed in the impeller and/or the at least one fluid bore is positioned in a region between the inner surface of the at least one projection and the plastic insert, and/or that the at least one fluid bore forms a flow channel with the at least one fluid channel running parallel to the axis. The flow channel is formed circumferentially between the plastic insert and the permanent magnet. It is advantageous that the at least one fluid channel running parallel to the axis is not formed in the region of the radial bearing. Consequently, the area for force-fit connections is increased, the quality of the concentricity of the rotor is improved, a higher possible radial load is enabled by a larger running surface, and a higher dirt load capacity is ensured since the fluid exchange does not take place via the bearing.

In a further development, a cover plate with at least one through-opening is arranged on the impeller and corresponds to the at least one fluid bore in the impeller and the at least one fluid channel running parallel to the axis. Through the through-hole in the cover plate, dirt particles or foreign bodies are diverted from the fluid flow and cannot enter into the at least one fluid channel.

Furthermore, it can be advantageously provided that a fluid flows around the permanent magnet rotor within the containment shell. The fluid flow around the permanent magnet within the containment shell forms a main cooling path. The fluid also serves as a lubricant for at least one bearing. Ventilation at the at least one bearing is advantageously ensured by the at least one fluid channel running parallel to the axis.

The at least one fluid channel running parallel to the axis in the plastic insert transports the fluid via a secondary flow path. The secondary flow path serves for heat dissipation as well as the cooling of the electronics on the circuit board via the containment shell and the fluid. The containment shell base is in direct contact with the circuit board. In addition, a thermally conductive foil or thermally conductive paste can be arranged between the containment shell base and the circuit board to enable better heat dissipation. It is important that there is no air gap between the containment shell base and the circuit board or the circuit board, the thermally conductive foil or thermally conductive paste and the containment shell base.

A projection of the containment shell together with the pump head and a motor housing form the housing. The projection of the containment shell, the pump head and the motor housing are screwed together. A seal is inserted between each individual housing part. As an alternative to screwing the housing parts, they can also be welded together or connected by means of another integral bonding, form-fitting or force-fitting method known to a person skilled in the art.

In particular, it can be provided that the liquid pump is used in water pumps, oil pumps, fuel pumps, SCR pumps in the automotive sector or in the household sector.

A method for producing a liquid pump is also provided, comprising the following method steps:

a) A plastic insert with an impeller is injection-molded in one piece from the same material;
b) During injection molding, at least one axially parallel rib is formed on the outer peripheral surface of the plastic insert, or the outer peripheral surface of the plastic insert is formed without ribs;
c) In addition, during injection molding, at least one projection is formed on an underside of the impeller and is arranged radially around a section of the plastic insert, at least one injection point and at least one material flattening is formed on its outer surface and/or on its inner surface and has at least one recess in the direction of the underside of the impeller;
d) In another step, the permanent magnetic material encloses the at least one projection and the at least one injection point and thereby forms the permanent magnet rotor during injection molding;
e) When applying the permanent magnetic material to the plastic insert, at least one fluid channel running parallel to the axis is formed between the plastic insert and the permanent magnet.

By forming at least one rib on the outer circumferential surface of the plastic insert, the rotor is balanced before applying the permanent magnetic material to the plastic insert. This ensures optimal concentricity of the rotor. In addition, the at least one rib creates a better form-fit between the plastic insert and the permanent magnetic material during injection molding.

BRIEF DESCRIPTION OF THE SEVERAL VIEWS OF THE DRAWINGS

The invention will now be described in more detail below with reference to the exemplary embodiments shown in the drawing. In the figures.

DETAILED DESCRIPTION OF THE INVENTION

Figure 1:
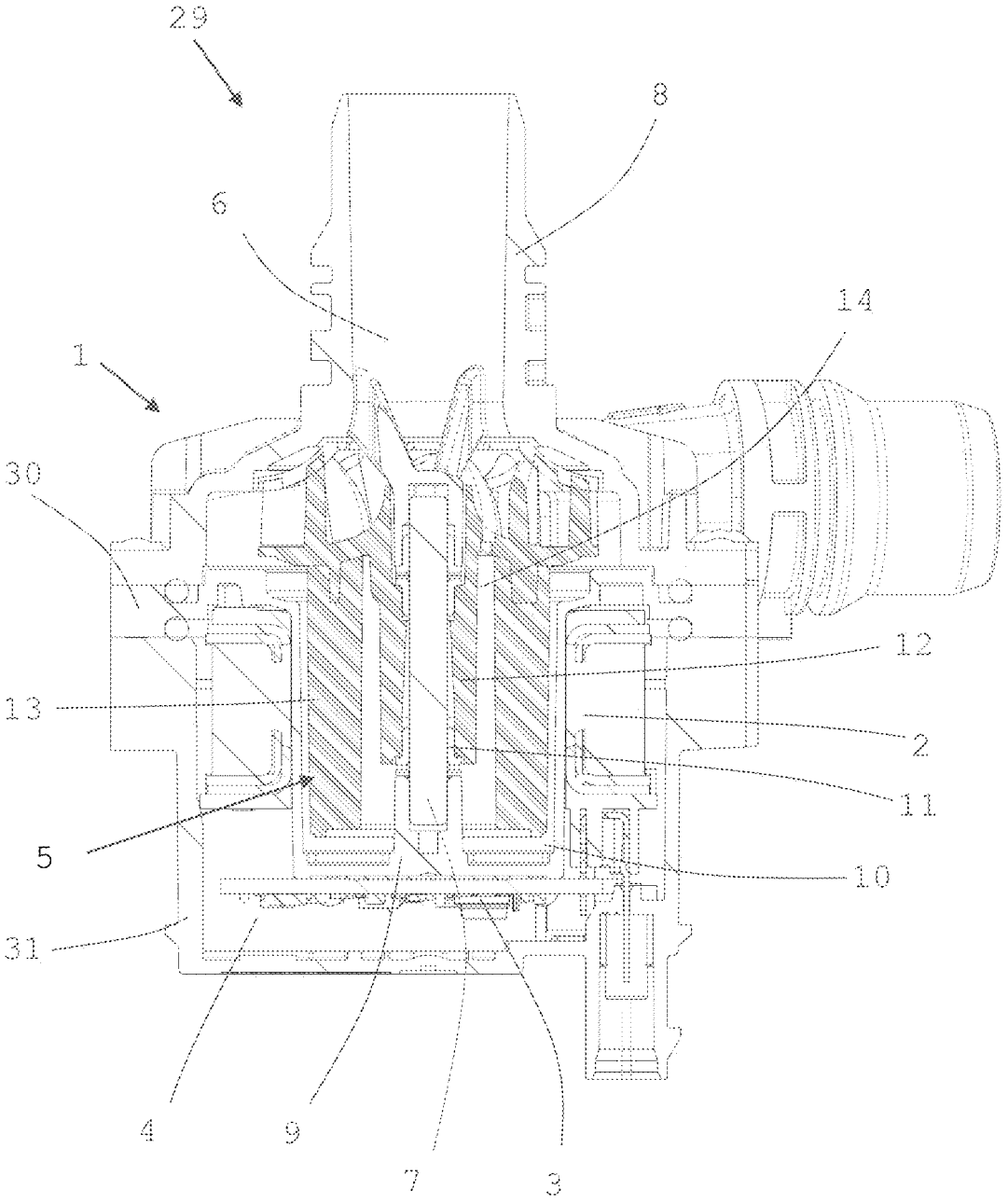
FIG. 1 shows an overview of a liquid pump according to an embodiment of the invention.

In describing preferred embodiments of the present invention illustrated in the drawings, specific terminology is employed for the sake of clarity. However, the invention is not intended to be limited to the specific terminology so selected, and it is to be understood that each specific element includes al technical equivalents that operate in a similar manner to accomplish a similar purpose.

FIG. 1 shows an overview of a liquid pump 29 according to an exemplary embodiment. The liquid pump 29 comprises a housing 1 in which a wound stator 2 and electronics 3 are arranged in a dry area 4. The liquid pump 29 further comprises a permanent magnet rotor 5 that is arranged in a wet area 6 and a shaft 7 that is held on the one hand in a pump head 8 and on the other hand in a shaft receptacle 9 in a containment shell 10. The containment shell 10 separates the dry area 4 from the wet area 6. Furthermore, at least one bearing 11 is provided which is incorporated in the permanent magnet rotor 5 and arranges it rotatably on the shaft 7. The permanent magnet rotor 5 comprises a plastic insert 12 and a permanent magnet 13. Furthermore, at least one fluid channel 14 running parallel to the axis is formed between the plastic insert 12 and the permanent magnet 13. The individual housing parts can be screwed, welded or connected to one another by means of another integral bonding, form-fitting or force-fitting method known to the person skilled in the art. In particular, a connection can be realized by a projection 30 of the containment shell 10, which together with the pump head 8 and a motor housing 31 forms the housing.

Figure 2:
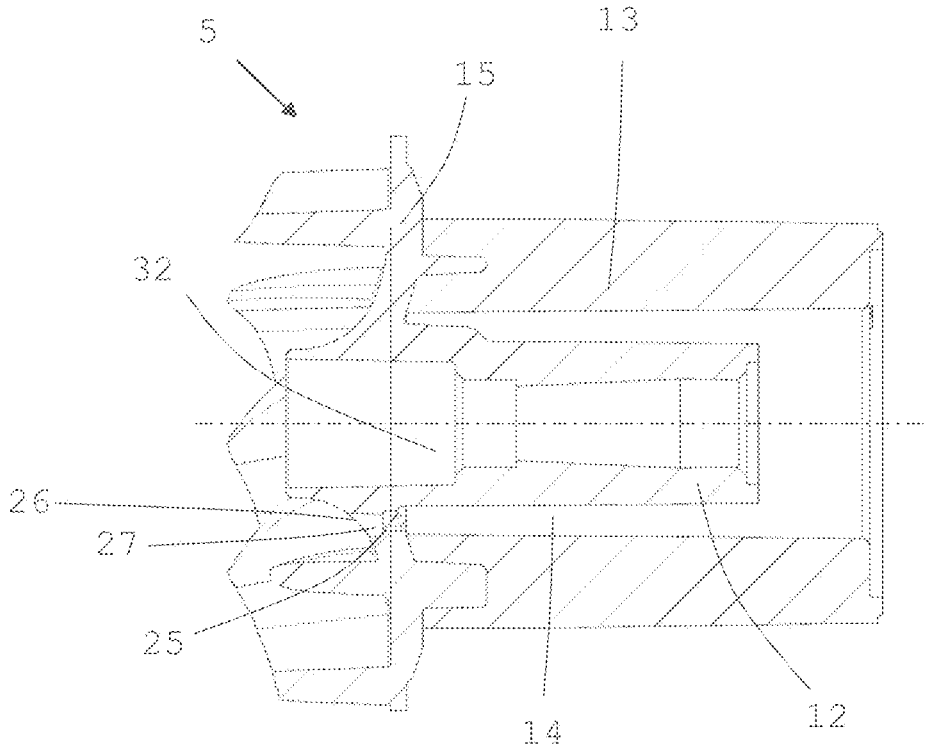
FIG. 2 shows a sectional view of the permanent magnet rotor according to FIG. 1.

FIG. 2 shows a sectional view of the permanent magnet rotor according to FIG. 1. The plastic insert 12 is formed in one piece with an impeller 15 made of the same material and forms the permanent magnet rotor 5 by being overmolded with permanent magnetic material. In particular, the plastic insert 12 and one or more permanent magnets 13 are designed as finished parts which are mounted in one another in a force-fit, integral bond or form-fit and thereby form the permanent magnet rotor 5. In its length, the plastic insert 12 is at least as long as the permanent magnet 13. Preferably, the plastic insert 12 is designed to be shorter so as not to rest on the shaft receptacle of the containment shell 10 (FIG. 1), i.e. the plastic insert does not touch the containment shell base. However, it would also be conceivable that the plastic insert 12 is longer than the permanent magnet 13. In its length, the plastic insert 12 is accordingly variably adapted to the length of the permanent magnet 13. For a circumferential flushing channel, it is advantageous to design the plastic insert 12 shorter in its length than the permanent magnet 13. The fluid channel 14 is formed by at least one fluid bore 25 in the impeller 15. In the inner region, the plastic insert 12 has a receiving contour 32 for the shaft 7 and the at least one bearing 11 as shown in FIG. 1. When applying the permanent magnetic material to the plastic insert 12, at least one fluid channel 14 running parallel to the axis is formed between the plastic insert 12 and the permanent magnet 13.

Figure 3:
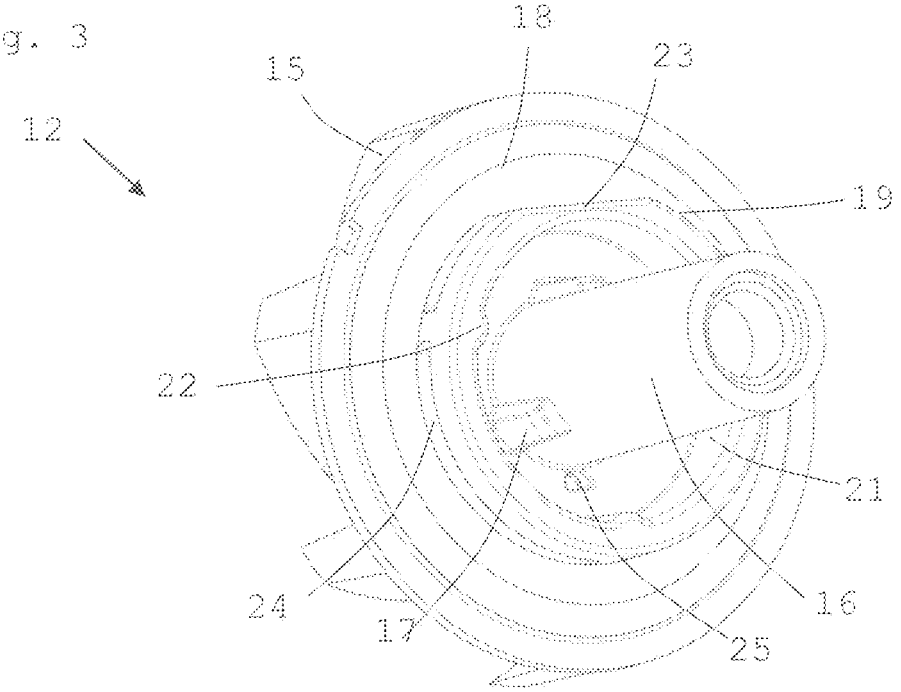
FIG. 3 shows an isometric view of a plastic insert according to an embodiment of the invention.
Figure 4:
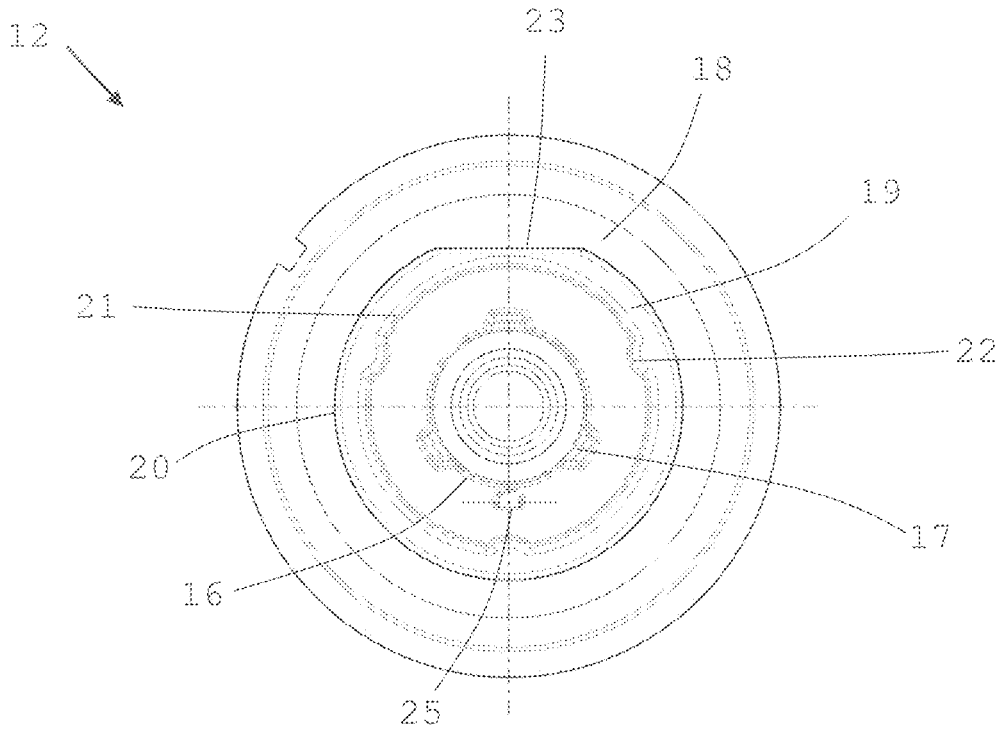
FIG. 4 shows a sectional view of a plastic insert according to FIG. 3.

FIGS. 3 and 4 show an isometric view of the plastic insert 12 according to an embodiment in which it is disclosed that the plastic insert 12 has at least one axially parallel rib 17 on its outer circumferential surface 16 or is designed without ribs. The at least one rib can be formed on the entire or only partially on the outer peripheral surface 16. At least one projection 19 is formed on an underside 18 of the impeller 15 and is formed radially around a section of the plastic insert 12. At least one injection point and at least one material flattening 23 are formed on the outer surface 20 (See FIG. 4) and/or the inner surface 21 of the at least one projection 19. In addition, the at least one projection 19 has at least one recess 24 in the direction of the underside 18 of the impeller 15. At least one fluid bore 25 is formed in the impeller 15 and/or the at least one fluid bore 25 is positioned in a region between the inner surface 21 of the at least one projection 19 and the plastic insert 12, and/or the at least one fluid bore 25 forms a flow channel with the at least one axially parallel fluid channel 14.

FIG. 4 shows a plan view of the plastic insert 12 according to FIG. 3.

Figure 5:
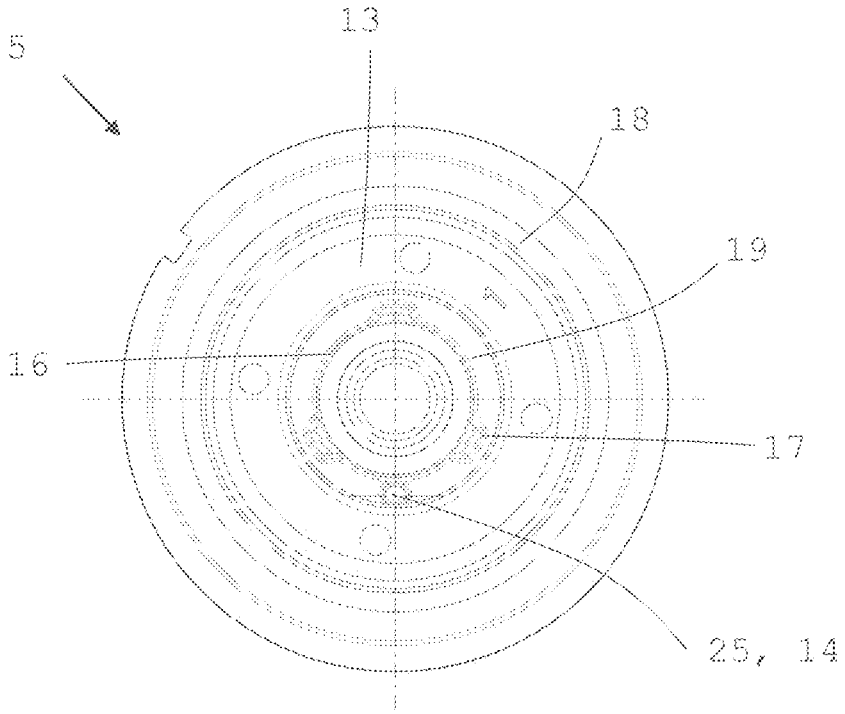
FIG. 5 shows a plan view of the permanent magnet rotor according to an embodiment of the invention.

FIGS. 3 and 5 show a plan view of the permanent magnet rotor 5 according to an embodiment. The permanent magnet rotor 5 comprises the plastic insert 12 (FIG. 3) and a permanent magnet 13. The plastic insert 12 has at least one axially parallel rib 17 on its outer peripheral surface 16. Alternatively, the outer peripheral surface 16 can also be designed without ribs 17. At least one projection 19 is formed on the underside 18 of the impeller 15 and is arranged radially around a section of the plastic insert 12. During the injection molding process, permanent magnetic material encloses the at least one projection 19 and the at least one injection point 22 and forms the permanent magnet rotor 5. When applying the permanent magnetic material to the plastic insert 12, at least one fluid channel 14 running parallel to the axis is formed, which corresponds to the at least one fluid bore 25 in the impeller 15.

Figure 6:
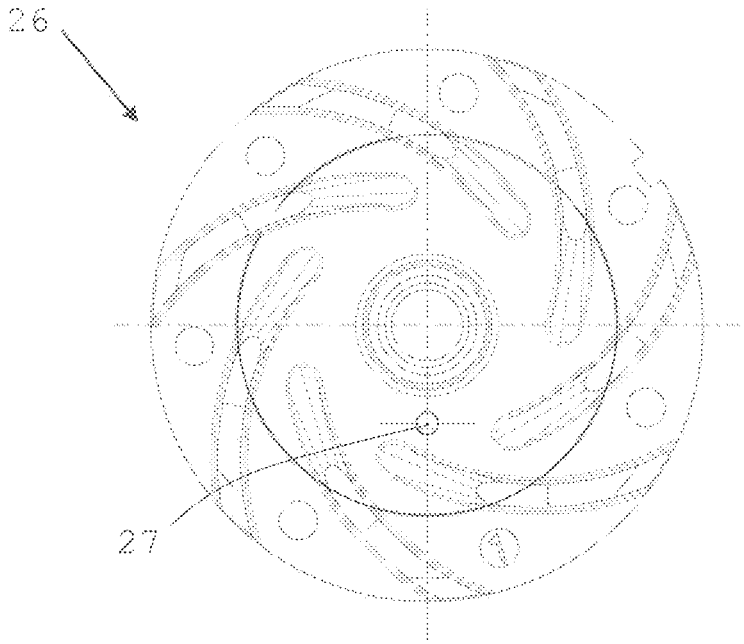
FIG. 6 shows a plan view of a cover plate.

FIGS. 3 and 6 show a plan view of a cover plate 26 according to an embodiment, which is arranged on the impeller 15. The cover plate 26 comprises at least one through-opening 27 and forms, together with the at least one fluid bore 25 in the impeller 15, at least one fluid channel 14 running parallel to the axis. Through the through-hole 27 in the cover plate 26, dirt particles or foreign bodies are diverted from the fluid flow and cannot enter into the at least one fluid channel 14.

Figure 7:
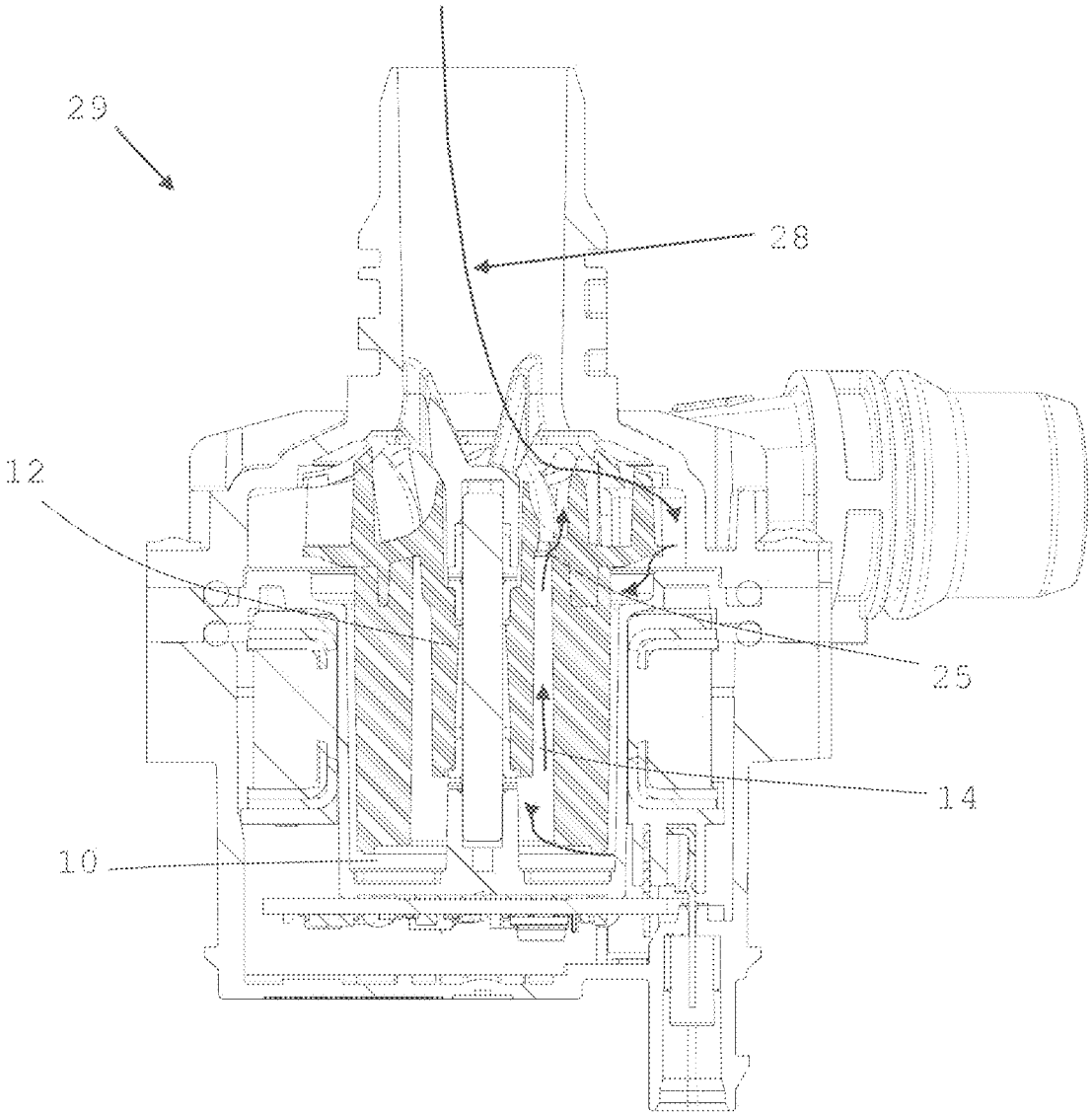
FIG. 7 shows a sectional view of a liquid pump according to an embodiment of the invention.

FIG. 7 shows a sectional view of a liquid pump according to an embodiment. A fluid 28 can be seen that flows around the permanent magnet rotor 5 inside the containment shell 10. This is a main cooling path which is fed from the at least one fluid bore 25. Furthermore, the fluid 28 is conveyed through the at least one fluid channel 14 running parallel to the axis in the plastic insert 12 via a secondary flow path. The secondary flow path serves for heat dissipation and the cooling of the electronics on the circuit board via the containment shell 10 and the fluid 28.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

LIST OF REFERENCE NUMBERS

1 Housing
2 Stator
3 Electronics
4 Dry area
5 Permanent magnet rotor
6 Wet area
7 Shaft
8 Pump head
9 Shaft receptacle
10 Containment shell
11 Bearing
12 Plastic insert
13 Permanent magnet
14 Fluid channel
15 Impeller
16 Outer peripheral surface
17 Rib
18 Underside

19 Projection
20 Outer surface
21 Inner surface
22 Injection point
23 Material flattening
24 Recess
25 Fluid bore
26 Cover plate
27 Through-hole
28 Fluid
29 Liquid pump
30 Containment shell projection
31 Motor housing
32. Receiving contour

What is claimed is:

1. A liquid pump with a housing in which a wound stator and electronics are arranged in a dry area, a permanent magnet rotor that is arranged in a wet area, a shaft that is held on the one hand in a pump head and on the other hand in a shaft receptacle in a containment shell, wherein the containment shell separates the dry area from the wet area, and at least one bearing which is incorporated in the permanent magnet rotor and arranges it rotatably on the shaft, wherein the permanent magnet rotor comprising: a plastic insert and a permanent magnet, and that at least one fluid channel running parallel to the axis is formed between the plastic insert and the permanent magnet, wherein at least one projection formed on an underside of the impeller, said projection being arranged radially around a section of the plastic insert, wherein at least one injection point is formed on an outer surface of the at least one projection and/or an inner surface of the at least one projection, and wherein permanent magnetic material encloses the at least one projection and the at least one injection point to form the permanent magnet rotor.

2. The liquid pump according to claim 1, wherein the plastic insert is formed in one piece with the impeller and is made of the same material.

3. The liquid pump according to claim 1, wherein the plastic insert has at least one axially parallel rib on its outer peripheral surface.

4. The liquid pump according to claim 1, wherein at least one material flattening is formed on an outer surface of the at least one projection and/or an inner surface of the at least one projection.

5. The liquid pump according to claim 1, wherein the at least one projection has at least one recess in the direction of the underside of the impeller.

6. The liquid pump according to claim 1, wherein when applying the permanent magnetic material to the plastic insert, the at least one fluid channel running parallel to the axis is formed between the plastic insert and the permanent magnet.

7. The liquid pump according to claim 1, wherein at least one fluid bore is formed in the impeller and/or the at least one fluid bore is positioned in a region between an inner surface of the at least one projection and the plastic insert, and/or that the at least one fluid bore forms a flow channel with the at least one fluid channel running parallel to the axis.

8. The liquid pump according to claim 7, wherein a cover plate with at least one through-opening arranged on the impeller and corresponds to the at least one fluid bore in the impeller and the at least one fluid channel running parallel to the axis.

9. The liquid pump according to claim 1, wherein a fluid flows around the permanent magnet rotor within the containment shell.

10. The liquid pump according to claim 9, wherein the at least one fluid channel running parallel to the axis between the plastic insert and the permanent magnet conveys the fluid via a secondary flow path.

11. The liquid pump according to claim 1, wherein the liquid pump is used in water pumps, oil pumps, fuel pumps, SCR pumps in the automotive sector or in the household sector.

* * * * *